US010857799B2

(12) United States Patent
Murashima

(10) Patent No.: US 10,857,799 B2
(45) Date of Patent: Dec. 8, 2020

(54) IMAGE FORMING APPARATUS

(71) Applicant: KYOCERA Document Solutions Inc., Osaka (JP)

(72) Inventor: Masaki Murashima, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/694,407

(22) Filed: Nov. 25, 2019

(65) Prior Publication Data

US 2020/0164671 A1 May 28, 2020

(30) Foreign Application Priority Data

Nov. 27, 2018 (JP) ..... 2018-221333

(51) Int. Cl.
*B41J 2/165* (2006.01)
*B41J 29/38* (2006.01)

(52) U.S. Cl.
CPC ..... *B41J 2/16505* (2013.01); *B41J 2/16535* (2013.01); *B41J 2/16538* (2013.01); *B41J 29/38* (2013.01); *B41J 2/16508* (2013.01)

(58) Field of Classification Search
CPC ..... B41J 2/16505; B41J 2/16535; B41J 2/16508; B41J 2/16511; B41J 29/10; B41J 29/38; B41J 29/02
See application file for complete search history.

(56) References Cited

U.S. PATENT DOCUMENTS

2008/0018721 A1* 1/2008 Umeda ..... B41J 2/17553

FOREIGN PATENT DOCUMENTS

JP 2001-293871 A 10/2001

* cited by examiner

*Primary Examiner* — Juanita D Jackson
(74) *Attorney, Agent, or Firm* — Studebaker & Brackett PC

(57) ABSTRACT

An image forming apparatus includes a housing, a movable body, a rack, a gear, a stepping motor, and a first action body. The movable body moves between a first position and a second position with respect to the housing. The first action body acts on the movable body. When an output shaft of the stepping motor rotates in a first rotation direction, the gear rotates to move the movable body in a first direction from the second position toward the first position. The first action body applies a pressing force toward a second direction opposite to the first direction to the movable body moving in the first direction beyond the first position. The pressing force is smaller than a force enough to rotate the output shaft of the stepping motor by one step in a second rotation direction opposite to the first rotation direction.

9 Claims, 7 Drawing Sheets

IMAGE FORMING APPARATUS

INCORPORATION BY REFERENCE

The present application claims priority under 35 U.S.C. § 119 to Japanese Patent Application No. 2018-221333, filed on Nov. 27, 2018. The contents of this application are incorporated herein by reference in their entirety.

BACKGROUND

The present disclosure relates to an image forming apparatus.

An inkjet printer includes a line head, a head cap, and a head frame. The line head forms an image with ink on paper. The head cap moves from a second position to a first position and closes the line head. The head frame guides the head cap between the second position and the first position. In the inkjet printer, the head cap moves in a right-left direction of the inkjet printer between the second position and the first position.

SUMMARY

An image forming apparatus according to an aspect of the present disclosure includes a housing, a movable body, a rack, a gear, a stepping motor, and a first action body. The movable body moves between a first position and a second position with respect to the housing. The rack is provided on the movable body. The gear engages with the rack. The stepping motor is provided in the housing. The first action body acts on the movable body. The stepping motor includes a motor body and an output shaft that rotates the gear. When the output shaft rotates in a first rotation direction, the gear rotates to move the movable body in a first direction from the second position toward the first position. The first action body applies a pressing force in a second direction opposite to the first direction to the movable body moving in the first direction beyond the first position. The pressing force is smaller than a force enough to rotate the output shaft of the stepping motor by one step in a second rotation direction opposite to the first rotation direction.

DETAILED DESCRIPTION

Figure 1:
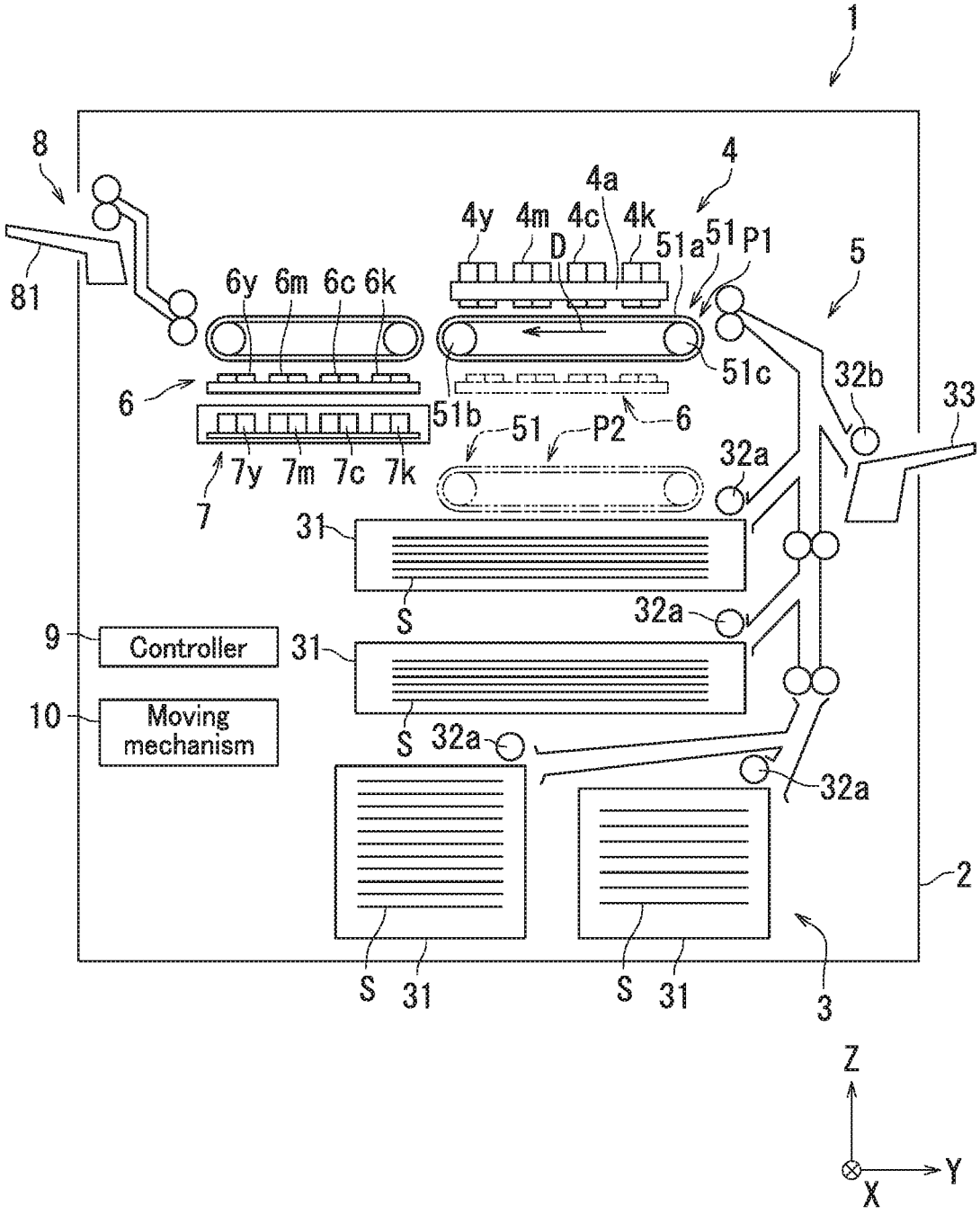
FIG. 1 is a diagram illustrating an inkjet recording apparatus according to an embodiment of the present disclosure.

The following describes an inkjet recording apparatus 1 according to an embodiment of the present disclosure with reference to drawings. The inkjet recording apparatus 1 is an example of an image forming apparatus. Note that elements that are the same or equivalent are indicated by the same reference signs in the drawings and description thereof is not repeated. The drawings mainly illustrate respective elements in a schematic manner for easy understanding.

With reference to FIG. 1, the inkjet recording apparatus 1 according to the present embodiment is described. FIG. 1 is a diagram illustrating the inkjet recording apparatus 1 according to the present embodiment. An X axis, a Y axis, and a Z axis in the diagram are perpendicular to each other. The X axis and the Y axis each extend in a direction parallel to a horizontal direction, and the Z axis extends in a direction parallel to a vertical direction. The Y-axis direction is opposite to a conveyance direction D.

As illustrated in FIG. 1, the inkjet recording apparatus 1 includes a housing 2, a sheet feed section 3, a recording head section 4, a conveyance section 5, a cap unit 6, a wiper unit 7, an ejection section 8, a controller 9, and a moving mechanism 10. The housing 2 accommodates the sheet feed section 3, the recording head section 4, the conveyance section 5, the cap unit 6, the wiper unit 7, the ejection section 8, the controller 9, and the moving mechanism 10.

The sheet feed section 3 includes sheet feed cassettes 31, sheet feed rollers 32*a*, a sheet feed roller 32*b*, and a manual feed tray 33. The sheet feed cassettes 31 are disposed in a lower part of the housing 2. The sheet feed cassettes 31 are detachably attached to the housing 2. In each of the sheet feed cassettes 31, a plurality of sheets S can be stored in a stacked state. A portion of the manual feed tray 33 is exposed from the housing 2 to the outside. On the manual feed tray 33, a plurality of sheets S can be loaded in a stacked state.

Each sheet S is, for example, plain paper, copy paper, recycled paper, thin paper, thick paper, glossy paper, or an overhead projector (OHP) sheet.

The sheet feed rollers 32*a* and the sheet feed roller 32*b* are pickup rollers. Each sheet feed roller 32*a* takes out the sheets S stored in the sheet feed cassette 31 one by one from the top. The sheet feed roller 32*b* takes out the sheets S loaded on the manual feed tray 33 one by one from the top. The sheet feed rollers 32*a* and the sheet feed roller 32*b* each send out the taken sheet S to the conveyance section 5.

The conveyance section 5 conveys the sheet S along a conveyance path of the sheet S. The conveyance path of the sheet S extends from the sheet feed section 3 to the ejection section 8 via the recording head section 4. The conveyance section 5 includes a conveyance unit 51 and a plurality of roller pairs disposed along the conveyance path.

The conveyance unit 51 conveys the sheet S in the conveyance direction D. The conveyance unit 51 includes a conveyor belt 51*a*, a driving roller 51*b*, and a driven roller 51*c*. The conveyor belt 51*a* is an endless belt. The conveyor belt 51*a* is stretched around the driving roller 51*b* and the driven roller 51*c*. The conveyance unit 51 conveys the sheet S with it loaded on a loading surface to the ejection section 8. The loading surface means a part of an outer surface of the conveyor belt 51*a* on which the sheet S is loaded.

The recording head section 4 is disposed to face the loading surface of the conveyance unit 51. The recording head section 4 forms an image with ink on the sheet S being conveyed by the conveyance unit 51. Subsequently, the sheet S with the image formed thereon is sent to the ejection section 8.

The recording head section 4 includes a head housing 4*a* and recording heads 4*y*, 4*m*, 4*c*, and 4*k*. The recording heads 4*y*, 4*m*, 4*c*, and 4*k* are each an exemplary ink nozzle. The recording heads 4*y*, 4*m*, 4*c*, 4*k* are held by the head housing 4*a*. The recording head 4*y* ejects a yellow ink. The recording head 4*m* ejects a magenta ink. The recording head 4*c* ejects a cyan ink. The recording head 4*k* ejects a black ink.

The ejection section 8 includes an exit tray 81. A portion of the exit tray 81 is exposed from the housing 2 to the outside. The sheet S with the image formed thereon is ejected onto the exit tray 81. The sheets S with an image formed thereon are stacked one by one on the exit tray 81.

The wiper unit 7 includes wiper blades 7*y*, 7*m*, 7*c*, and 7*k*. The wiper blades 7*y*, 7*m*, 7*c*, and 7*k* clean the recording head section 4. The wiper blade 7*y* corresponds to the recording head 4*y*. The wiper blade 7*m* corresponds to the recording head 4*m*. The wiper blade 7*c* corresponds to the recording head 4*c*. The wiper blade 7*k* corresponds to the recording head 4*k*.

The cap unit 6 includes caps 6*y*, 6*m*, 6*c*, and 6*k*. The cap 6*y* corresponds to the recording head 4*y*. The cap 6*m* corresponds to the recording head 4*m*. The cap 6*c* corresponds to the recording head 4*c*. The cap 6*k* corresponds to the recording head 4*k*.

For example, the caps 6*y*. 6*m*, 6*c*, and 6*k* cover the recording heads 4*y*. 4*m*, 4*c*, and 4*k* when the recording head section 4 is not used for a specific time period or longer. As a result, drying of the inks of the recording heads 4*y*, 4*m*, 4*c*, and 4*k* is prevented.

The controller 9 controls operation of the inkjet recording apparatus 1. Specifically, the controller 9 includes a processor such as a central processing unit (CPU), and a storage device such as a hard disk drive and memory. The storage device stores therein various computer programs executed by the processor. The processor executes the various computer programs stored in the storage device to control the sheet feed section 3, the recording head section 4, the conveyance section 5, the cap unit 6, the wiper unit 7, and the moving mechanism 10.

Figure 2:
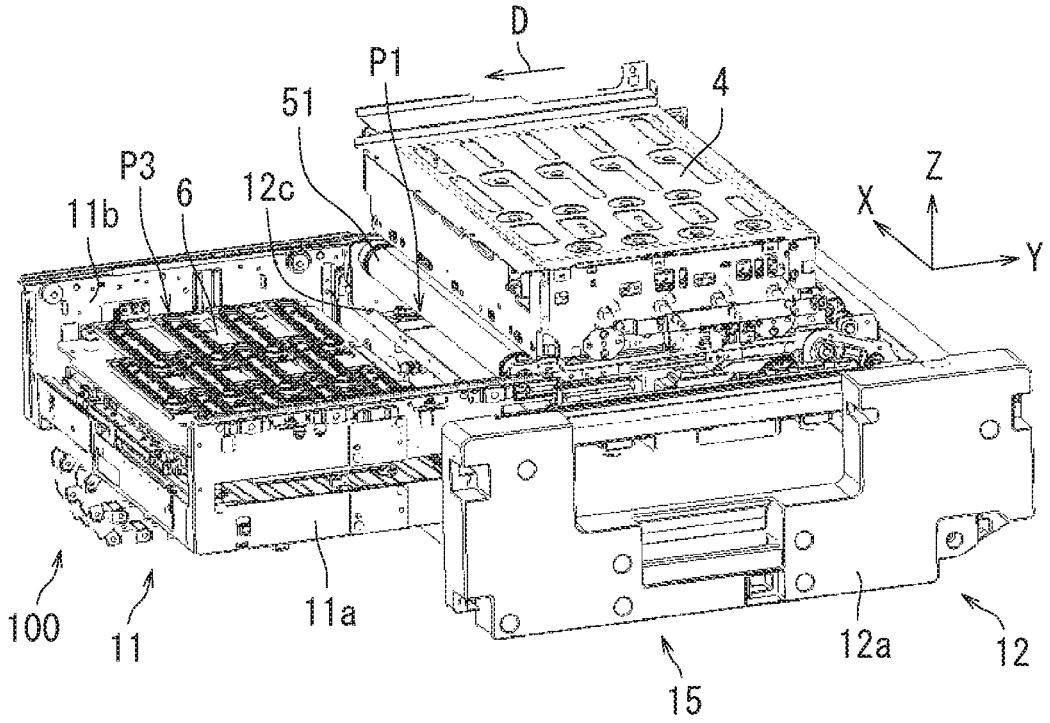
FIG. 2 is a perspective view illustrating a state in which a conveyance unit in the embodiment is located at an upper limit position and a state in which a movable body in the embodiment is located at a retraction position.
Figure 3:
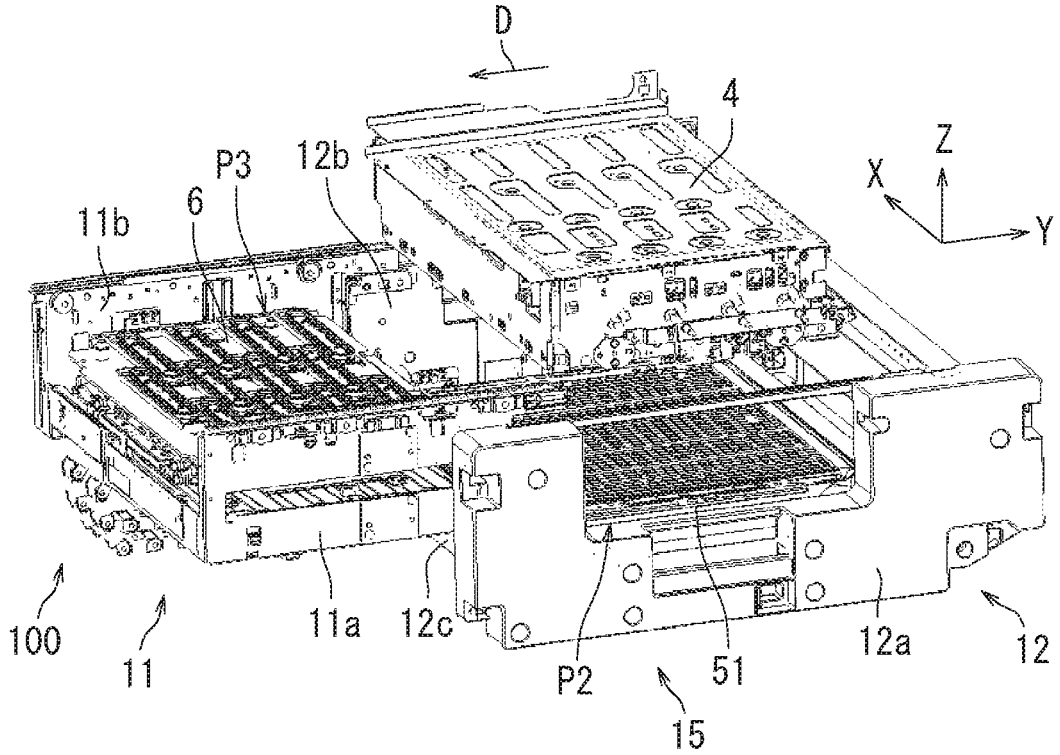
FIG. 3 is a perspective view illustrating a state in which the conveyance unit in the embodiment is located at a lower limit position and a state in which the movable body in the embodiment is located at a retraction position.

Next, with reference to FIGS. 1 to 5, the movement of the conveyance unit 51, the cap unit 6, and the wiper unit 7 is described in detail. FIGS. 2 and 3 are perspective views illustrating the conveyance unit 51 and a movable body 100. In FIG. 2, the conveyance unit 51 is located at an upper limit position P1, and the movable body 100 is located at a retraction position P3. In FIG. 3, the conveyance unit 51 is located at a lower limit position P2, and the movable body 100 is located at the retraction position P3.

The upper limit position P1 is a position at which the conveyance unit 51 is close to the recording head section 4. The lower limit position P2 is a position which is vertically below the upper limit position P1 and at which the conveyance unit 51 is separated from the recording head section 4. The retraction position P3 is a position to which the movable body 100 is moved in the conveyance direction D relative to the recording head section 4.

As illustrated in FIGS. 1 to 3, the moving mechanism 10 moves the conveyance unit 51, the cap unit 6, and the wiper unit 7 within the housing 2. The moving mechanism 10 includes a second casing 12, a movable body moving mechanism 15, and a conveyance unit moving mechanism (not illustrated).

The second casing 12 is fixed to the housing 2. The second casing 12 includes a wall 12*a* and a wall 12*b*, and a support plate 12*c* parallel to the XY plane. The wall 12*a* and the wall 12*b* face each other in the X-axis direction. The conveyance unit 51 is placed on the support plate 12*c*.

The conveyance unit moving mechanism moves the conveyance unit 51 placed on the support plate 12*c* up and down between the upper limit position P1 and the lower limit position P2 in the second casing 12. The loading surface of the conveyance unit 51 at the upper limit position P1 faces the recording head section 4 in a vertical direction. At the upper limit position P1, the loading surface of the conveyance unit 51 is close to the lower end of the recording head section 4 at a clearance sufficient for conveyance of the sheet S (for example, 3 mm). By contrast, at the lower limit position P2, the clearance between the loading surface of the conveyance unit 51 and the lower end of the recording head section 4 is, for example, 200 mm.

Figure 4:
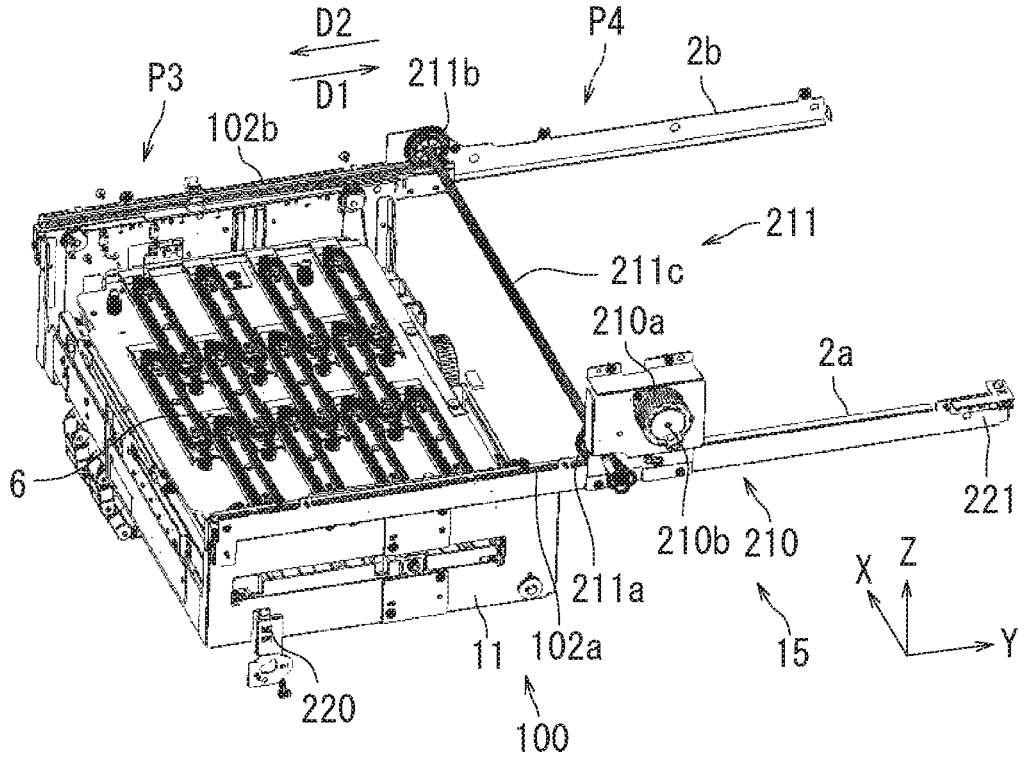
FIG. 4 is a perspective view illustrating a state in which the movable body in the embodiment is located at the retraction position.
Figure 5:
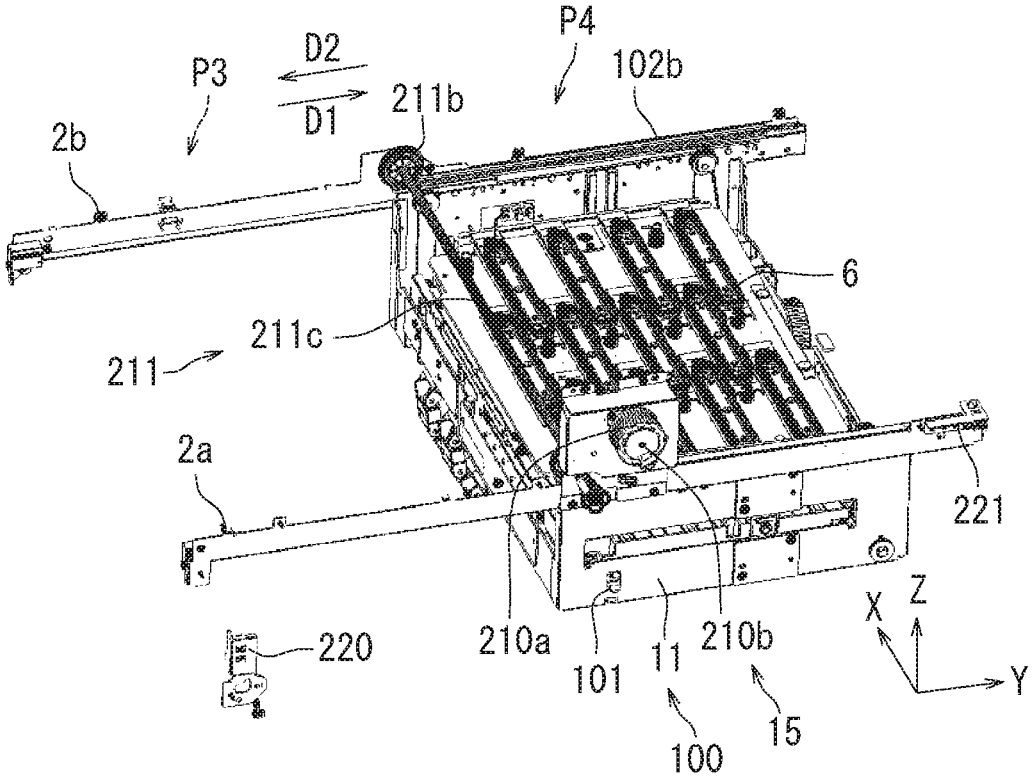
FIG. 5 is a perspective view illustrating a state in which the movable body in the embodiment is located at a standby position.

FIG. 4 is a perspective view illustrating a state in which the movable body 100 is located at the retraction position P3. FIG. 5 is a perspective view illustrating a state in which the movable body 100 is located at a standby position P4. As illustrated in FIGS. 2 to 5, the movable body 100 includes a first casing 11, the cap unit 6, the wiper unit 7, a first blocking member 103, and a second blocking member 101. The standby position P4 is an example of the first position. The retraction position P3 is an example of the second position. The first casing 11 is an example of a carriage. The standby position P4 is a position at which the movable body 100 faces the recording head section 4 in a vertical direction.

The first casing 11 includes a wall 11*a* and a wall 11*b*. The wall 11*a* and the wall 11*b* face each other in the X-axis direction. The first casing 11 supports at least one unit of the cap unit 6 and the wiper unit 7. In the present embodiment, the first casing 11 supports the cap unit 6 and the wiper unit 7.

The housing 2 of the inkjet recording apparatus 1 includes paired rails 2*a* and 2*b*, a first detector 221, and a second detector 220. The first detector 221 is an example of a detector. The paired rails 2*a* and 2*b* are fixed to the housing 2 and extend in a predetermined direction. The predetermined direction is, for example, the horizontal direction and is substantially parallel to the conveyance direction D of the sheet S.

The first detector 221 detects that the movable body 100 is located at the standby position P4. The first detector 221 is fixed to an end of the rail 2*a* on a side of the standby position P4. The first detector 221 includes a light emitting element and a light receiving element that are disposed with a predetermined distance therebetween.

The first blocking member 103 of the movable body 100 blocks an optical path between the light emitting element and the light receiving element of the first detector 221 when the movable body 100 is located at the standby position P4. The first blocking member 103 is, for example, a plate-like body. The first detector 221 outputs a signal indicating that the optical path is blocked to the controller 9. In this way, the controller 9 recognizes that the movable body 100 is located at the standby position P4.

The second detector 220 detects that the movable body 100 is located at the retraction position P3. The second detector 220 is fixed to the housing 2. The second detector 220 includes a light emitting element and a light receiving element that are disposed with a predetermined distance therebetween.

The second blocking member 101 of the movable body 100 blocks an optical path between the light emitting element and the light receiving element of the second detector 220 when the movable body 100 is located at the retraction position P3. The second blocking member 101 is, for example, a plate-like body. The second detector 220 outputs a signal indicating that the optical path is blocked to the controller 9. In this way, the controller 9 recognizes that the movable body 100 is located at the retraction position P3.

Here, the movable body moving mechanism 15 is described in detail. As illustrated in FIGS. 4 and 5, the movable body moving mechanism 15 moves the movable body 100 between the retraction position P3 and the standby position P4 along the paired rails 2*a* and 2*b*. The movable body moving mechanism 15 includes a gear unit 211 and a stepping motor 210.

The inkjet recording apparatus 1 further includes a first rack 102*a* and a second rack 102*b*. The first rack 102*a* is provided in an upper portion of the wall 11*a*. The second rack 102*b* is provided in an upper portion of the wall 11*b*.

The gear unit 211 includes a first gear 211*a*, a second gear 211*b*, and a connecting shaft 211*c*. The connecting shaft 211*c* connects a rotating shaft of the first gear 211*a* and a rotating shaft of the second gear 211*b*. The first gear 211*a* meshes with the first rack 102*a*. The second gear 211*b* meshes with the second rack 102*b*.

The stepping motor 210 is provided in the second casing 12. The stepping motor 210 includes a motor body 210*a* and an output shaft 210*b* that rotates the first gear 211*a* when energized. The output shaft 210*b* extends in a horizontal direction. The output shaft 210*b* includes a gear 210*c* on a side near a tip end thereof (see FIG. 8).

When the output shaft 210*b* rotates in a first rotation direction, the first gear 211*a* and the second gear 211*b* rotate to move the movable body 100 in the first direction D1 from the retraction position P3 toward the standby position P4. Specifically, during movement of the movable body 100 from the retraction position P3 to the standby position P4, the controller 9 outputs a predetermined number of pulse waves to the stepping motor 210. When the output shaft 210*b* of the stepping motor 210 rotates by a predetermined number of steps in the first rotation direction, the movable body 100 moves from the retraction position P3 to the standby position P4.

Figure 6:
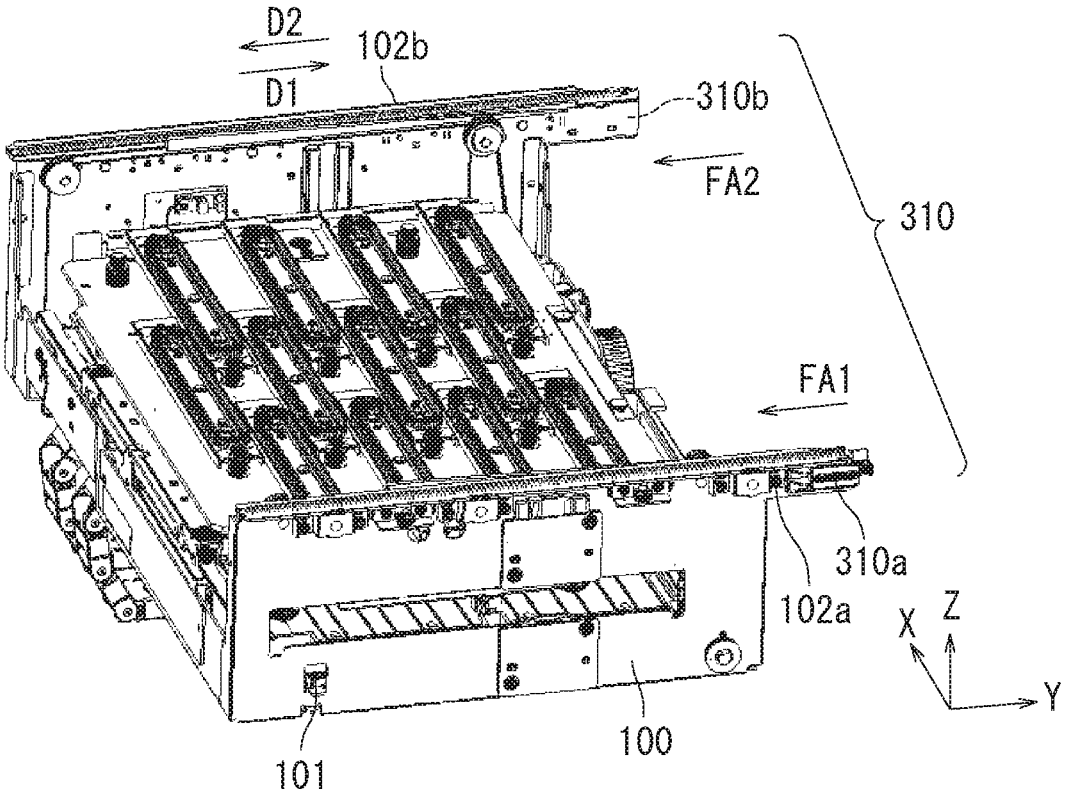
FIG. 6 is a perspective view illustrating the movable body in the embodiment.
Figure 7:
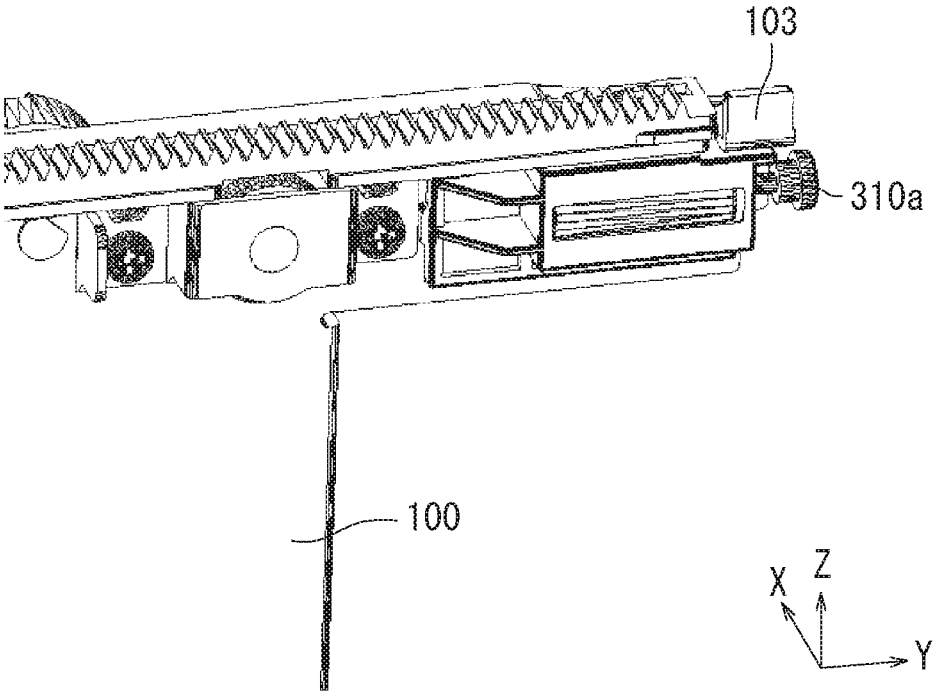
FIG. 7 is a perspective view illustrating a first action body in the embodiment.

With reference to FIGS. 6 and 7, first action bodies 310 are described. The movable body 100 further includes two first action bodies 310. One of the two first action bodies 310 is referred to as 310*a*, and the other is referred to as 310*b*. FIG. 6 is a perspective view illustrating the movable body 100. FIG. 7 is a perspective view illustrating the first action body 310*a*. As shown in FIGS. 6 and 7, each of the first action body 310*a* and the first action body 310*b* includes a damper. The damper includes, for example, an elastic body that absorbs impact. A specific example of the damper is an oil damper. The first action body 310*a* and the first action body 310*b* are arranged at the respective ends of the movable body 100 in the first direction D1.

Figure 8:
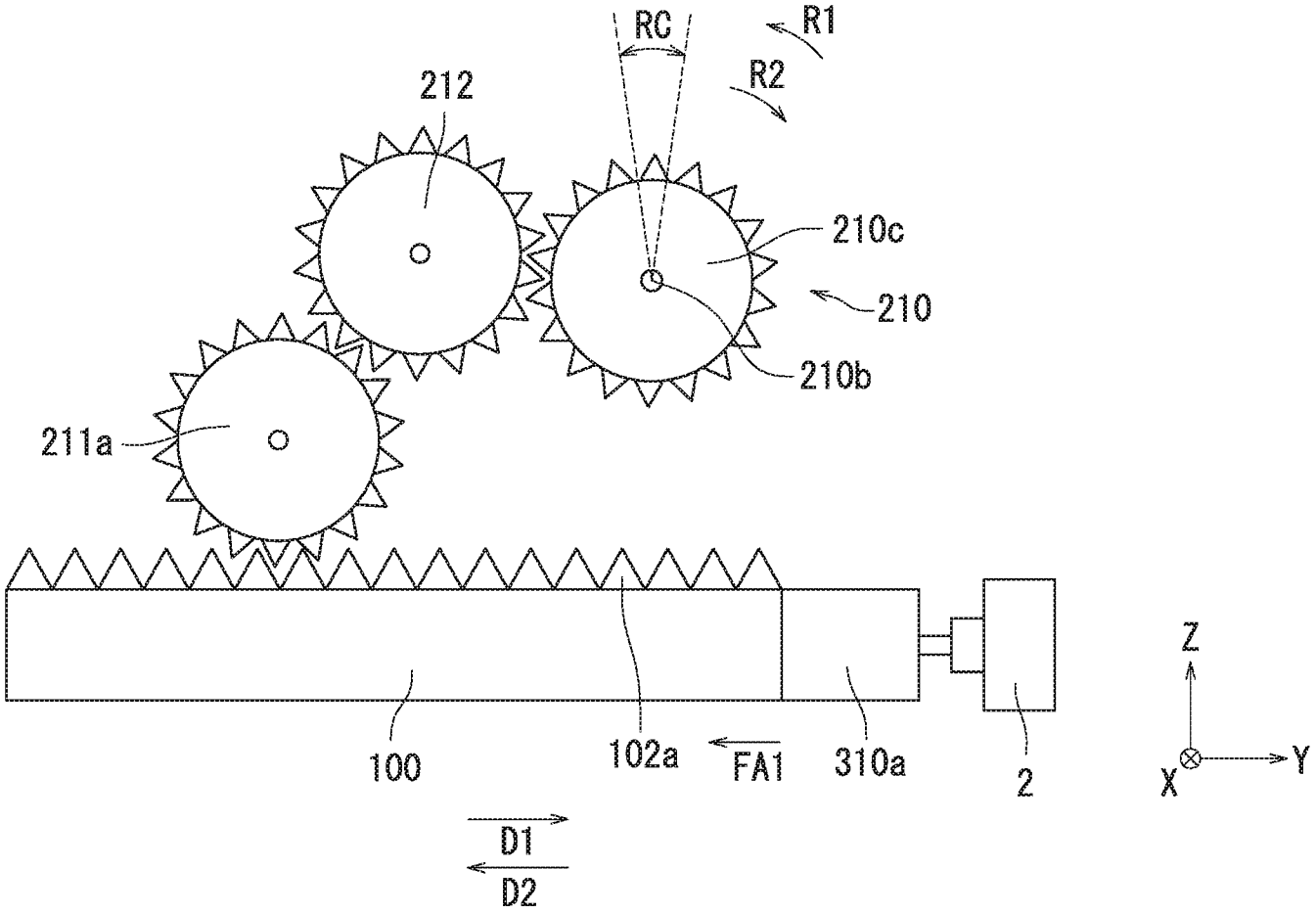
FIG. 8 is a diagram illustrating a relationship among the first action body, an output shaft, a first gear, a first rack, the movable body, and a connecting gear in the embodiment.

With reference to FIG. 8, the first action body 310*a* that acts on the movable body 100 is described in detail. FIG. 8 is a diagram illustrating a relationship among the first action body 310*a*, the output shaft 210*b*, the first gear 211*a*, the first rack 102*a*, the movable body 100, and the connecting gear 212.

As illustrated in FIG. 8, rotation of the output shaft 210*b* in the first rotation direction R1 rotates the connecting gear 212. The rotation of the connecting gear 212 rotates the first gear 211*a*. The rotation of the first gear 211*a* moves the movable body 100 provided with the first rack 102*a* in the first direction D1. In this manner, the output shaft 210*b* rotates in the first rotation direction R1 by a predetermined number of steps to move the movable body 100 from the retraction position P3 to the standby position P4.

Even when the output shaft 210*b* stops the rotation in the first rotation direction R1, an inertial force acts on the movable body 100 having a heavy weight. As a result, due to the presence of the first gear 211*a* and the connecting gear 212 between the stepping motor 210 and the first rack 102, and also the presence of play RC in the rotational direction for the meshing of each gear, the movable body 100 continues to move in the first direction D1 beyond the standby position P4. The movable body 100 continues to moving in the first direction D1, and therefore, the first action body 310*a* contacts the housing 2 and the first action body 310*b* also contacts the housing 2 before the movable body 100 stops.

The first action body 310*a* applies a pressing force FA1 (restoring force) toward a second direction D2 opposite to the first direction D1 to the movable body 100 moving in the first direction D1 beyond the standby position P4. Specifically, the first action body 310*a* contracts as a result of contacting the housing 2. After the contraction, the first action body 310*a* having a force to expand again is pushed back by the housing 2. As with the first action body 310*a*, the first action body 310*b* also applies a pressing force FA2 in the second direction D2 to the movable body 100.

The pressing force FA1 is smaller than a force enough to rotate the output shaft 210*b* of the stepping motor 210 by one step in the second rotation direction R2 opposite to the first rotation direction R1 (retaining force). Accordingly, application of the pressing force FA1 moves the movable body 100 in the second direction D2. As a result of the movement of the movable body 100 in the second direction D2, the first gear 211*a* is rotated by the first rack 102*a*. The rotation of the first gear 211*a* rotates the connecting gear 212. Even when the connecting gear 212 rotates, the output shaft 210*b* only rotates less than one step in the second rotation direction R2.

Therefore, according to the present embodiment, even when the predetermined magnitude of force is applied to the output shaft 210*b*, the output shaft 210*b* does not rotate in the second rotation direction R2, and therefore, the movable body 100 stops. Thus, it is possible to stop the movable body 100 at a predetermined position. That is, it is possible to accurately stop the movable body 100 at the standby position P4 as a specified position.

In the present embodiment, the first action body 310 includes the first action body 310*a* and the first action body 310*b*. The total force of the pressing force FA1 and the pressing force FA2 is set smaller than the force enough to rotate the output shaft 210*b* of the stepping motor 210 by one step in the second rotation direction R2 opposite to the first rotation direction R1 (retaining force).

In a situation in which the stepping motor 210 is energized even after the predetermined number of pulse waves are output to the stepping motor 210, the total force of the pressing force FA1 and the pressing force FA2 is set smaller than the force enough to rotate the output shaft 210*b* of the energized stepping motor 210 by one step in the second rotation direction R2. In a situation in which the stepping motor 210 is not energized after the predetermined number of pulse waves are output to the stepping motor 210, the total force of the pressing force FA1 and the pressing force FA2 is set smaller than the force enough to rotate the output shaft 210*b* of the non-energized stepping motor 210 by one step in the second rotation direction R2.

The total force of the pressing force FA1 and the pressing force FA2 is a force enough to move the movable body 100 having a heavy weight.

Thus, the movable body 100 to which the total force of the pressing force FA1 and the pressing force FA2 is applied moves in the second direction D2. As a result of the movement of the movable body 100 in the second direction D2, the first gear 211*a* is rotated by the first rack 102*a*. The rotation of the first gear 211*a* rotates the connecting gear 212. Even when the connecting gear 212 rotates, the output shaft 210*b* only rotates less than one step in the second rotation direction R2.

Therefore, according to the present embodiment, it is possible to accurately stop the movable body 100 at the standby position P4 as a specified position.

According to the present embodiment, as a result of the inkjet recording apparatus 1 including the recording heads 4*y*. 4*m*, 4*c*, and 4*k*, and the movable body 100 including the caps 6*y*, 6*m*, 6*c*, and 6*k*, the caps 6*y*, 6*m*, 6*c*, and 6*k* are enabled to accurately cover the recording heads 4*y*, 4*m*, 4*c*, and 4*k*.

Furthermore, according to the present embodiment, when the first action body 310*a* and the first action body 310*b* are disposed as dampers at the respective ends of the movable body 100 in the first direction D1, the dampers act to absorb and repel impact, and thus are enabled to apply appropriate pressing force (restoring force) to the movable body 100. Further, when the two first action bodies 310 are provided at the respective ends of the movable body 100 in the first direction D1, the first action body 310*a* and the first action body 310*b* can be reduced in size.

According to the present embodiment, when the inkjet recording apparatus 1 includes the first detector 221 and the first blocking member 103, the first blocking member 103 is capable of blocking the optical path between the light emitting element and the light receiving element even in a case where the blocking member 103 is reduced in size.

Figure 9:
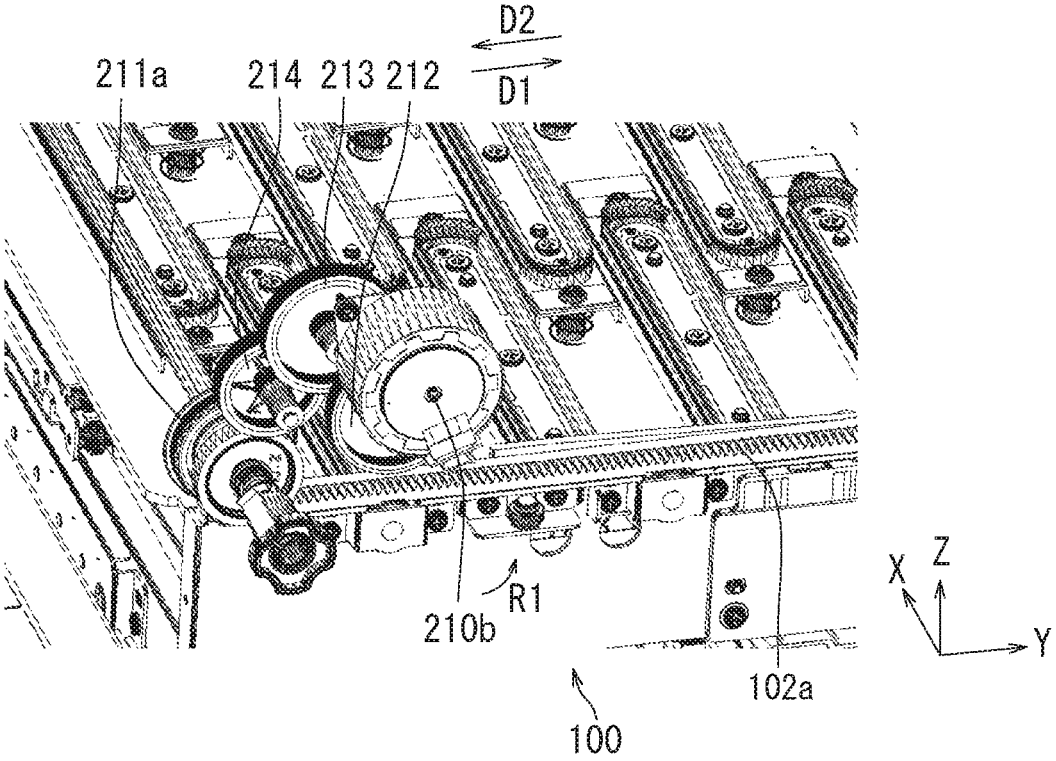
FIG. 9 is a diagram illustrating an inkjet recording apparatus in the embodiment including a plurality of connecting gears.
Figure 10:
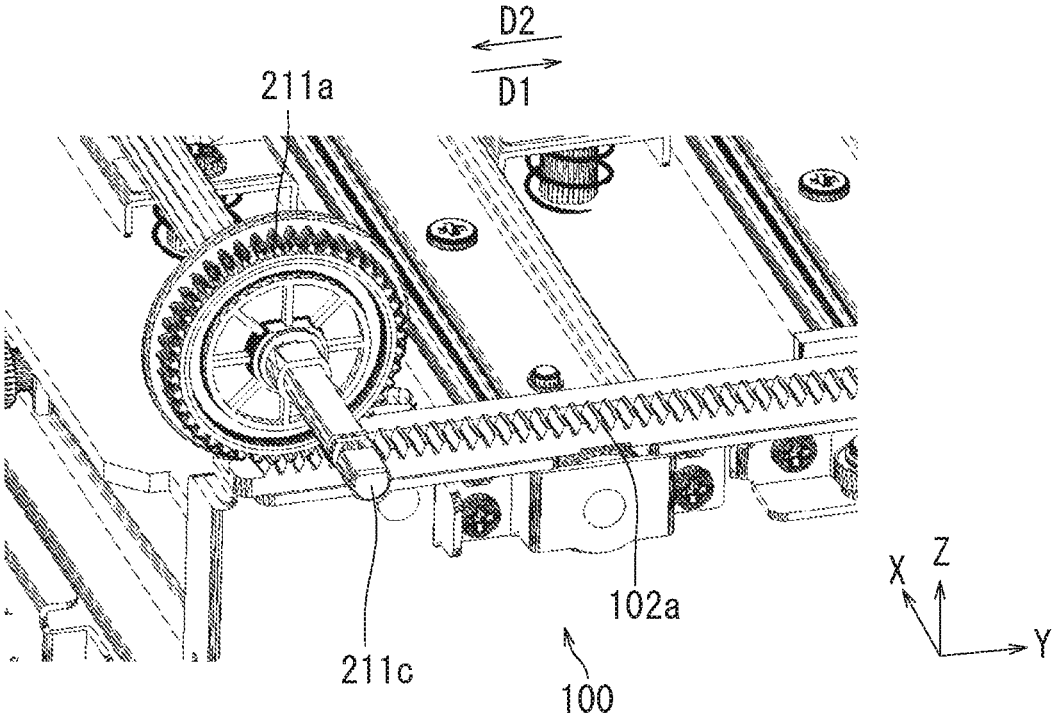
FIG. 10 is a diagram illustrating a relationship between the first gear and the first rack in the embodiment.

With reference to FIGS. 9 and 10, a case where a plurality of connecting gears 212 to 214 are disposed between the output shaft 210*b* and the first gear 211*a* is described. The inkjet recording apparatus 1 may further include a plurality of connecting gears 212 to 214 disposed between the output shaft 210*b* and the first gear 211*a*. FIG. 9 is a diagram illustrating the inkjet recording apparatus 1 including the connecting gears 212 to 214. FIG. 10 is a diagram illustrating a relationship between the first gear 211*a* and the first rack 102*a*.

As illustrated in FIG. 9, rotation of the output shaft 210*b* in the first rotation direction R1 rotates the connecting gear 212. The rotation of the connecting gear 212 rotates the connecting gear 213. The rotation of the connecting gear 213 rotates the connecting gear 214. The rotation of the connecting gear 214 rotates the first gear 211*a*. The rotation of the first gear 211*a* moves the movable body 100 provided with the first rack 102*a* in the first direction D1. In this manner, the output shaft 210*b* rotates in the first rotation direction R1 by a predetermined number of steps in the first rotation direction R1 to move the movable body 100 from the retraction position P3 to the standby position P4.

Even when the output shaft 210*b* stops the rotation in the first rotation direction R1, due to the presence of the first gear 211*a* and the plurality of connecting gears 212 to 214 between the stepping motor 210 and the first rack 102*a*, and also the presence of the play RC in the rotational direction for the meshing of each gear, the movable body 100 continues to move in the first direction D1 beyond the standby position P4. As illustrated in FIGS. 6 and 8, the movable body 100 continues to moving in the first direction D1, and therefore, the first action body 310*a* contacts the housing 2 and the first action body 310*b* also contacts the housing 2 before the movable body 100 stops.

The first action body 310*a* applies the pressing force FA1 (restoring force) in the second direction D2 to the movable body 100 moving in the first direction D1 beyond the standby position P4. As with the first action body 310*a*, the first action body 310*b* also applies the pressing force FA2 in the second direction D2 to the movable body 100.

The total force of the pressing force FA1 and the pressing force FA2 is smaller than the force enough to rotate the output shaft 210*b* of the stepping motor 210 by one step in the second rotation direction R2 (retaining force). Also, the total force of the pressing force FA1 and the pressing force FA2 is a force enough to move the movable body 100 having a heavy weight.

Thus, the movable body 100 to which the total force of the pressing force FA1 and the pressing force FA2 is applied moves in the second direction D2. As a result of the movement of the movable body 100 in the second direction D2, the first gear 211*a* is rotated by the first rack 102*a*. The rotation of the first gear 211*a* rotates the connecting gear 214. The rotation of the connecting gear 214 rotates the connecting gear 213. The rotation of the connecting gear 213 rotates the connecting gear 212. Even when the connecting gear 212 rotates, the output shaft 210*b* only rotates less than one step in the second rotation direction R2.

Therefore, according to the present embodiment, since the first gear 211*a* and the connecting gears 212 to 214 are disposed between the stepping motor 210 and the first rack 102*a*, it is possible to accurately stop the movable body 100 at the standby position P4 even when the movable body 100 continues to move in the direction D1 for a long distance beyond the standby position P4.

Figure 11:
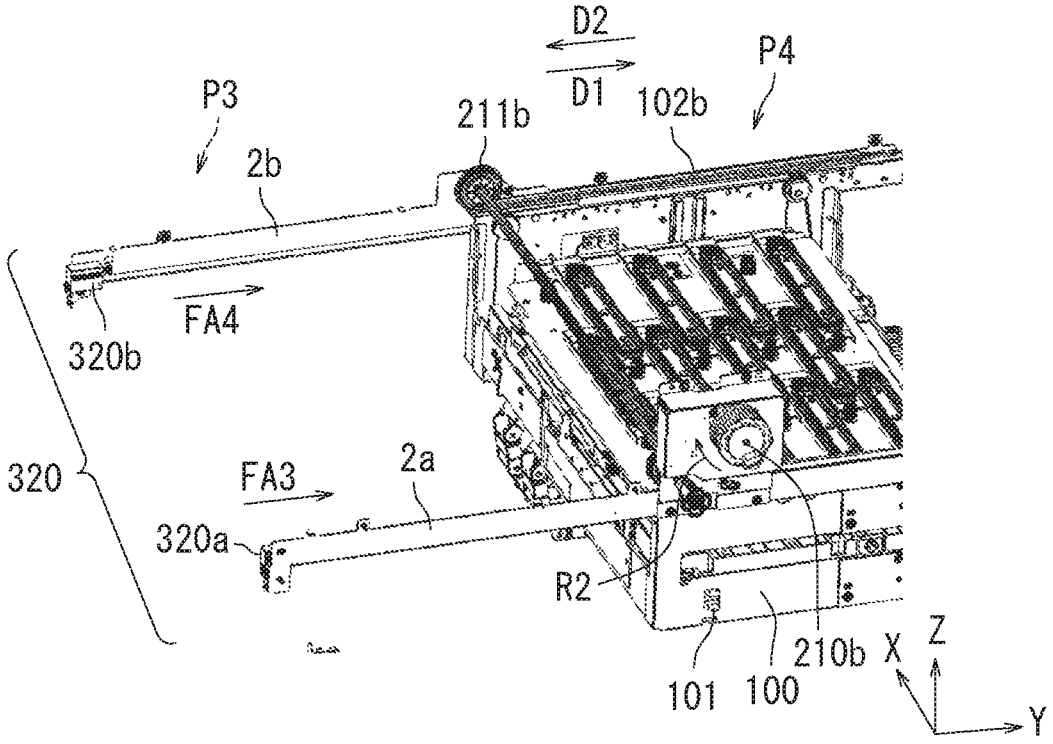
FIG. 11 is a perspective view illustrating the movable body, a pair of rails, and a second action body in the embodiment.
Figure 12:
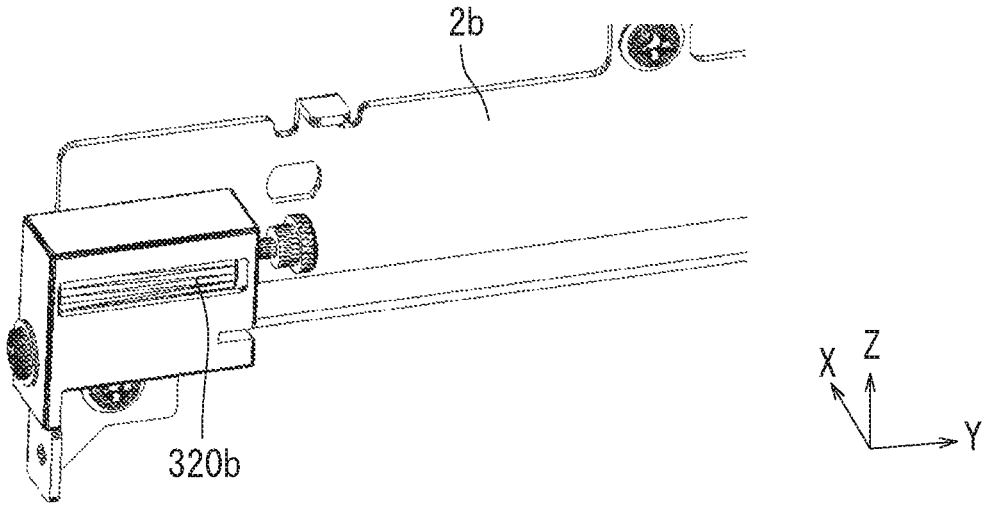
FIG. 12 is a perspective view illustrating the second action body in the embodiment.

With reference to FIGS. 11 and 12, a second action body 320 is described. Preferably, the inkjet recording apparatus 1 further includes two second action bodies 320. One of the two second action bodies 320 is referred to as 320*a*, and the other is referred to as 320*b*. FIG. 11 is a perspective view illustrating the movable body 100, the paired rails 2*a* and 2*b*, and the second action body 320. FIG. 12 is a perspective view illustrating the second action body 320*b*. As illustrated in FIGS. 11 and 12, each of the second action body 320*a* and the second action body 320*b* includes a damper. The second action bodies 320 are disposed at respective ends of the paired rails 2*a* and 2*b*.

As illustrated in FIGS. 8, 11, and 12, rotation of the output shaft 210*b* in the second rotation direction R2 rotates the connecting gear 212. The rotation of the connecting gear 212 rotates the first gear 211*a*. The rotation of the first gear 211*a* moves the movable body 100 provided with the first rack 102*a* in the second direction D2. In this manner, the output shaft 210*b* rotates in the second direction D2 by a predetermined number of steps to move the movable body 100 from the standby position P4 to the retraction position P3.

Even when the output shaft 210*b* stops the rotation in the second rotation direction R2, due to the presence of the first gear 211*a* and the connecting gear 212 between the stepping motor 210 and the first rack 102*a*, and also the presence of the play RC in the rotational direction for the meshing of each gear, the movable body 100 continues to move in the second direction D2 beyond the retraction position P3. The movable body 100 continues to moving in the second direction D2, and therefore, the movable body 100 contacts the second action body 320*b* and also the second action body 320*a* before the movable body 100 stops.

The second action body 320*b* applies a pressing force FA4 (restoring force) in the first direction D1 to the movable body 100 moving in the second direction D2 beyond the retraction position P3, and the second action body 320*a* also applies a pressing force FA3 in the first direction D1 as with the second action body 320*b*.

The total force of the pressing force FA3 and the pressing force FA4 is smaller than the force enough to rotate the output shaft 210*b* of the stepping motor 210 by one step in the first rotation direction R1 (retaining force). The total force of the pressing force FA3 and the pressing force FA4 is a force enough to move the movable body 100 having a heavy weight.

Thus, the movable body 100 to which the total force of the pressing force FA3 and the pressing force FA4 is applied moves in the first direction D1. As a result of the movement of the movable body 100 in the first direction D1, the first gear 211*a* is rotated by the first rack 102*a*. The rotation of the first gear 211*a* rotates the connecting gear 212. Even when the connecting gear 212 rotates, the output shaft 210*b* only rotates less than one step in the first rotation direction R1.

Therefore, according to the present embodiment, it is possible to accurately stop the movable body 100 at the retraction position P3 as a specified position.

Further, according to the present embodiment, when the second action bodies 320 are provided at the respective ends of the paired rails 2*a* and 2*b*, the second action body 320*a* and the second action body 320*b* can be reduced in size.

According to the present embodiment, when the inkjet recording apparatus 1 includes the second detector 220 and the second blocking member 101, the second blocking member 101 is enabled to block the optical path between the light emitting element and the light receiving element of the second detector 220 even in a case where the blocking member 101 is reduced in size.

Hereinbefore, an embodiment of the present disclosure has been described with reference to the drawings. However, the present disclosure is not limited to the above embodiment and may be implemented in various different forms that do not deviate from the essence of the present disclosure. The drawings schematically illustrate elements of configuration in order to facilitate understanding, and properties of elements of configuration illustrated in the drawings, such as thicknesses, lengths, and numbers thereof, may differ from actual properties thereof in order to facilitate preparation of the drawings. Shapes, dimensions, and the like of the elements of configuration given in the above embodiment are merely examples that do not impose any particular limitations and may be altered in various ways so long as such alterations do not substantially deviate from the configuration of the present disclosure.

(1) As described with reference to FIGS. 1 to 12, the image forming apparatus is an inkjet recording apparatus 1. However, the present disclosure is not limited thereto. The image forming apparatus may be, for example, an electrophotographic recording apparatus or a monochrome multifunction peripheral.

(2) As described with reference to FIGS. 1 to 12, the inkjet recording apparatus 1 includes two first action bodies 310. However, the present disclosure is not limited thereto. It is possible that the inkjet recording apparatus 1 includes only one first action body. Also, the inkjet recording apparatus 1 includes two second action bodies 320, but the present disclosure is not limited thereto. It is possible that the inkjet recording apparatus 1 includes only one second action body.

(3) As described with reference to FIGS. 1 to 12, the standby position P4 is the first position and the retraction position P3 is the second position. However, the present disclosure is not limited thereto. It is possible that the retraction position P3 is the first position and the standby position P4 is the second position.

What is claimed is:

1. An image forming apparatus comprising:
- a housing;
- a movable body configured to move between a first position and a second position with respect to the housing;
- a rack provided at the movable body;
- a gear configured to mesh with the rack;
- a stepping motor provided in the housing; and
- a first action body configured to act on the movable body, wherein
- the stepping motor includes a motor body and an output shaft that rotates the gear,
- when the output shaft rotates in a first rotation direction, the gear rotates to move the movable body in a first direction from the second position toward the first position,
- the first action body applies a pressing force in a second direction opposite to the first direction to the movable body moving in the first direction beyond the first position, and
- the pressing force is smaller than a force enough to rotate the output shaft of the stepping motor by one step in a second rotation direction opposite to the first rotation direction.

2. The image forming apparatus according to claim 1, wherein
- the first action body includes a damper.

3. The image forming apparatus according to claim 1, comprising as the first action body, two first action bodies, wherein
- the two first action bodies are disposed at an end of the movable body in the first direction.

4. The image forming apparatus according to claim 1, further comprising
- a recording head section that includes an ink nozzle, wherein
- the movable body includes:
  - at least one of a cap unit capable of covering the ink nozzle and a wiper unit that cleans the ink nozzle; and
  - a carriage that supports the at least one of the cap unit and the wiper unit included in the movable body, and
- the carriage is provided with two racks including the rack provided at the movable body.

5. The image forming apparatus according to claim 1, further comprising
- a detector configured to detect that the movable body is located at the first position.

6. The image forming apparatus according to claim 5, wherein the detector includes a light emitting element and a light receiving element that are disposed with a predetermined distance therebetween, the movable body includes a blocking member, and the blocking member blocks an optical path between the light emitting element and the light receiving element when the movable body is located at the first position.

7. The image forming apparatus according to claim 1, further comprising a connecting gear disposed between the output shaft and the gear, wherein rotation of the output shaft rotates the gear via the connecting gear.

8. The image forming apparatus according to claim 1, further comprising a second action body configured to act on the movable body, wherein when the output shaft rotates in the second rotation direction, the gear rotates to move the movable body in the second direction, the second action body applies a pressing force in the first direction to the movable body moving in the second direction beyond the second position, and the pressing force is smaller than a force enough to rotate the output shaft of the stepping motor by one step in the first rotation direction.

9. The image forming apparatus according to claim 8, further comprising paired rails that are fixed to the housing and extend in a predetermined direction; and as the second action body, two second action bodies, wherein the second action bodies are disposed at ends of the respective paired rails in the second direction.

* * * * *